US007469549B2

(12) United States Patent
Ahlberg

(10) Patent No.: US 7,469,549 B2
(45) Date of Patent: Dec. 30, 2008

(54) METHODS OPTIMIZING AVAILABLE ENERGY IN INSULATED PACKAGING SYSTEMS FOR DOOR-TO-DOOR DISTRIBUTION IN AN UNBROKEN COLD CHAIN

(75) Inventor: Bo Gunnar Ahlberg, Dallas, TX (US)

(73) Assignee: Kelvin Technologies, Inc., Dallas, TX (US)

( * ) Notice: Subject to any disclaimer, the term of this patent is extended or adjusted under 35 U.S.C. 154(b) by 469 days.

(21) Appl. No.: 10/687,053

(22) Filed: Oct. 17, 2003

(65) Prior Publication Data

US 2006/0178779 A1 Aug. 10, 2006

(51) Int. Cl.
*G05D 23/32* (2006.01)
*F25B 19/00* (2006.01)
*F25D 3/08* (2006.01)

(52) U.S. Cl. ..... 62/157; 62/228.1; 62/231; 62/457.1; 236/1 C

(58) Field of Classification Search ..... 236/51, 236/1 C; 62/126, 129, 157, 228.1, 231, 440, 62/457.1
See application file for complete search history.

(56) References Cited

U.S. PATENT DOCUMENTS 4,003,728 A * 1/1977 Rath ..... 62/78
5,969,606 A * 10/1999 Reber et al. ..... 340/540
6,311,509 B1 * 11/2001 Cartwright et al. ..... 62/213
6,390,378 B1 * 5/2002 Briscoe et al. ..... 236/44 C
6,679,071 B1 * 1/2004 Storey et al. ..... 62/126
6,863,222 B2 * 3/2005 Slifkin et al. ..... 236/51
2002/0020188 A1 * 2/2002 Sharon et al. ..... 62/371
2003/0085215 A1 * 5/2003 Rix ..... 219/386
2004/0200232 A1 * 10/2004 Gano et al. ..... 62/457.2
2004/0226309 A1 * 11/2004 Broussard ..... 62/236
2007/0193297 A1 * 8/2007 Wilson ..... 62/371

* cited by examiner

*Primary Examiner*—Marc E Norman
(74) *Attorney, Agent, or Firm*—Cash Klemchuk Powers Taylor LLP; Keith E. Taber; Darin M. Klemchuk

(57) ABSTRACT

An electronic device controlling available energy consumption during time by its communication with another electronic device measuring deviations between set up information and indicative information. The electronic devices, as a part of a physical system, includes but is not limited to control, measure, record, verify and report the operation of the physical system. The physical system create the environment for the packaged product, controls the environment of the packaged product, enable distribution of the packaged product, monitor and log the data from the environment and of the packaged product. The physical system can be defined as a packaging system but may also be cold storage rooms, refrigerators, transportation vessels, machinery and line of production, hospitals or laboratories.

2 Claims, 4 Drawing Sheets

Control system set-up

Control system activation

METHODS OPTIMIZING AVAILABLE ENERGY IN INSULATED PACKAGING SYSTEMS FOR DOOR-TO-DOOR DISTRIBUTION IN AN UNBROKEN COLD CHAIN

1. FIELD OF THE INVENTION

The invention is generally directed to optimize the use of energy to maintain in transit product (substance) temperature and in particular when used in packaging systems with limited available energy, i.e. no external power source available. Such packaging systems could be refrigerated air cargo containers, refrigerated freight containers or other transportation vessels that carry available energy within its own system.

1.1 BACKGROUND OF THE INVENTION

Temperature sensitive goods constitute a large share of the product inventory of every pharmaceutical company. Unfortunately, each year millions of dollars in temperature sensitive pharmaceuticals are destroyed in transit. In order to maintain quality, all temperature sensitive substances must be continuously stored at the appropriate temperature from the time they are manufactured up until the moment of use. Once substance potency is lost, it cannot be regained or restored, and without proper care, any substance may eventually lose all its potency. If this occurs, the substance will no longer provide any protection against the target disease and is then useless.

The system used for keeping and distributing substances in good condition is called the 'cold chain'. This consists of a series of storage and transport links, all of which are designed to keep the substance at the correct temperature until it reaches the user. When temperature sensitive substances are distributed, special protection in terms of packaging is needed. The Health Care Industry has worked hard to develop its own set of specialized packaging systems. However, even the best packaging system can be defeated by an unexpected deviation in time or ambient temperature. Preserving the value and effectiveness of the substance while meeting the demands of on-time delivery is one of the greatest challenges facing the Health Care Industry today.

The available packaging systems on the market today carry the energy within the same system as where the substance is packed. The control system is designed to measure and regulate the air temperature within the packaging system at one set point. Air temperature within the packaging system fluctuate much more then substance temperature, mainly due to great difference in thermal mass, when ambient in-transit temperature fluctuate due to the environment that the packaging system is exposed to.

When the temperature of the air in the packaging system change, the control system will utilize its energy source to maintain the temperature of the air inside the packaging system, although the temperature of the product has not been affected. More energy then what is actually required will be consumed and, in the end of a distribution, there is no power left to maintain air temperature and the appropriate substance temperature may exceed.

Therefore, it is a need to optimize the use of available energy by allowing the temperature of the substance to fluctuate within given alarms, sacrificing the energy in the thermal mass of the substance, extending the actual time of effective operation of the packaging system. This should be done in conjunction with balancing the actual energy losses in the packaging system.

1.1.1 Weaknesses of Current Methods

The control system does not measure the temperature of the substance so that the energy in the substance can be sacrificed within recognized alarms The air temperature in the packaging system fluctuate significantly more than substance temperature The packaging system may not record in transit product temperature The weight of the energy in the packaging system generates additional costs not beneficial for the substance itself The packaging system is increasingly hazardous for its environment with an increased amount of energy carried within the packaging system should a mechanical failure occur

1.2 SUMMARY OF THE INVENTION

The invention is directed to:

Monitor and record in transit substance temperature.

Allow the substance temperature to fluctuate within its alarms and thereby consume less energy within the packaging system.

Optimize the use of energy carried within the packaging system.

The packaging system can in general case be any objects having an electronic device that may optimize the use of available energy. Furthermore, a substance that needs to be transported under temperature control is of special interest, since it is more dependent on the amount of energy that is available. In particular, the present innovation is best suited for packaging systems carried by transportation vessels.

2.2 BRIEF DESCRIPTION OF THE DRAWINGS

The invention together with further objects and advantages thereof may best be understood by making references to the following description taken together with the accompanying drawings, in which.

2.3 DETAILED DESCRIPTION OF THE INVENTION

Figure 1:
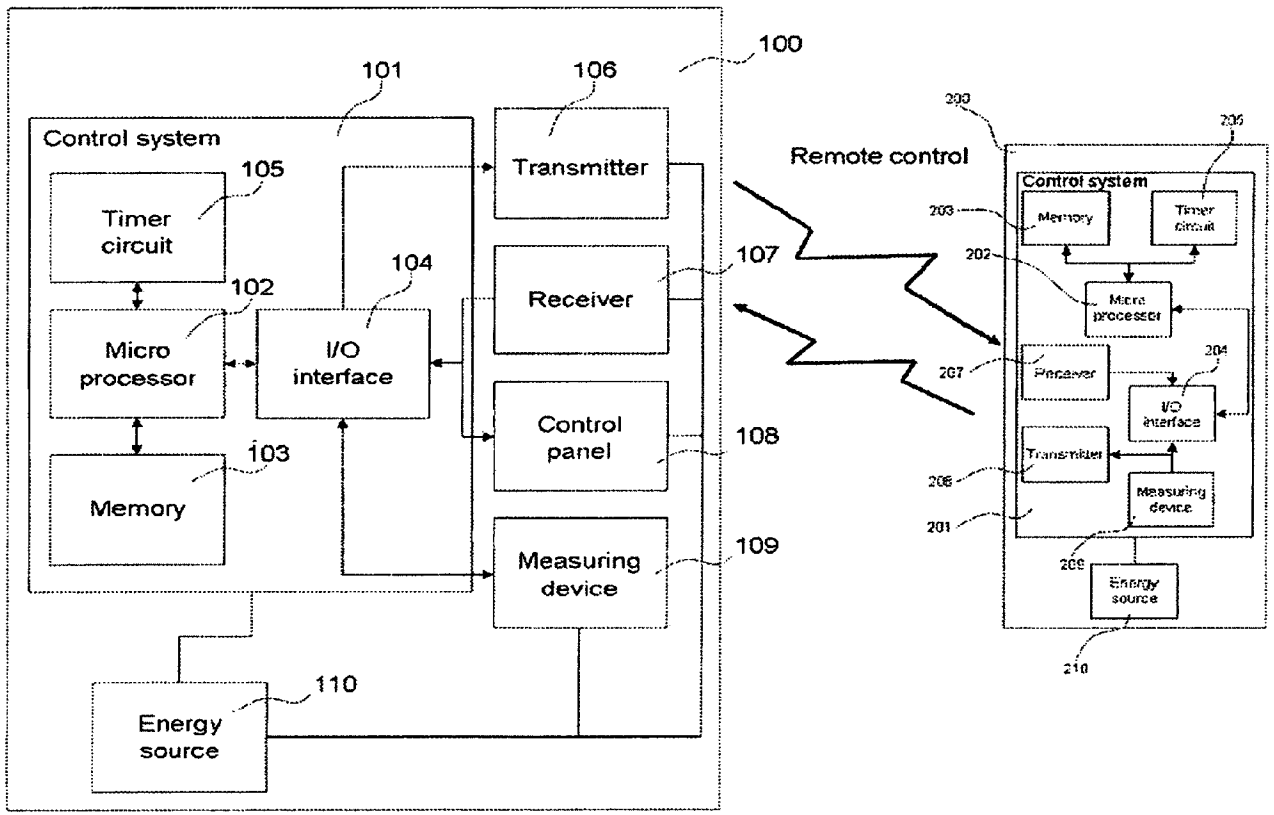
FIG. 1 is a schematic illustration of components and embodiment of electronic devices according to the present invention.

Referring to the drawings in general, it will be understood that the illustrations are for the purpose of describing preferred embodiments of the invention and are not intended to limit the invention to the details thereof.

FIG. 1.

FIG. 1 schematically illustrates a typical external device 100 according to one embodiment of the present invention. The external device 100 or an object to which the external device 100 is associated exchange vital functional and operational information for the optimization of energy within the packaging system. The external device 100 includes a control system 101 that includes a microprocessor 102 operatively connected with a memory 103, an input/output interface 104 and a timer circuit 105. The microprocessor 102 interfaces with devices outside the control system 101 through the input/output interface 104. If the microprocessor 102 needs to carry out instructions or operations based on time, the microprocessor 102 uses the timer circuit 105.

The internal device 200 or an object to which the internal device 200 is associated exchange vital functional and operational information for the optimization of energy within the packaging system. The internal device 200 includes an internal control system 201 that includes an internal microprocessor 202 operatively connected with an internal memory 203, an internal input/output interface 204 and an internal timer circuit 205. The internal microprocessor 202 interfaces with devices outside the internal control system 201 through the internal input/output interface 204. If the internal microprocessor 202 needs to carry out instructions or operations based on time, the internal microprocessor 202 uses the internal timer circuit 205.

The energy source 110 supplies power to the external device 100. The energy source 110 is limited and carried within the packaging system. The energy source 110 is connected to the external device 100 so that the control system 101 functions can operate as long as energy remains. However, the power to the external device 100 may also be supplied by an external energy source. The external energy source may recharge the energy source 110 through the input/output interface 104 when connected to an external energy source. The energy source 110 may also provide power so that the temperature of the substance in the packaging system can remain within its alarms.

The internal energy source 210 supplies power to the internal device 200. The internal energy source 210 is limited and carried within the internal device 200. The internal energy source 210 is connected to the internal device 200 so that the internal control system 201 functions can operate as long as energy remains.

The external device 100 may also contain a transmitter 106. The transmitting device 106 sends signals being interpretable as set up information representing substance temperature alarms, set by the control panel 108, to the internal device 200. The signals are remotely send to internal device 200 upon its activation.

The internal device 200 may also contain an internal receiver 207. The internal device 200 can be activated by the control system 101 and is placed in close proximity to the substance that is transported in the packaging system to monitor and log the temperature of the substance.

The internal device 200 may also contain an internal measuring device 209. The internal measuring devices 209 monitor temperature of the substance that is transported in the packaging system. The internal transmitting device 206 transmits temperature related data from the internal device 200 to the external device 100 where the data is processed.

The internal device 200 may also contain an internal transmitter 206. The internal transmitter 206 sends signals being interpretable as actual substance temperature from the internal measurement device 209 through the internal input/output interface 204 to the external device 100. The signals are remotely send to external device 100.

The external device 100 may also contain a receiver 107. The receiving device 107 receives signals being interpretable as actual substance temperature from internal device 200. The control system 101 shall activate the energy source in close proximity to set substance alarms through the input/output interface 104.

The external device 100 may also contain a control panel 108. The control panel device 108 provides access to functions that shall be controlled by the control system 101 through the input/output interface 104. Functions that may be controlled are the operational mode of external device 100 and the activation/de-activation mode of internal device 200.

The external device 100 may also contain measuring device 109. The measuring device 109 monitors temperature of the in/out coming air in the cargo area as well as the ambient temperature outside the packaging system. The transmitting device 106 transmits temperature related data from the external device 100 to the internal device 200 where the data is recorded in its internal memory 203. The control system 101 shall activate the energy source in close proximity to set substance alarms through the input/output interface 104 should internal device 200 fail to operate in transit.

The external device 100 may also contain a memory 103. The memory 103 store operational information related to the functions that may control the mode of external device 100.

The external device 100 may also contain a microprocessor 102. The microprocessor 102 controls which devices within and/or associated with the external device 100 that receive power by controlling the distribution of the energy source 110.

The internal device 200 may record time based in transit temperature data in its internal memory 203. It is remotely communicating with external device 100 shortly after its activation.

The internal device 200 may also contain an internal microprocessor 202. The internal microprocessor 202 controls which devices within and/or associated with the internal device 200 that receive power by controlling the distribution of the internal energy source 210.

The information recorded in the internal device 200 may be retrieved on a PC computer or similar through the internal input/output interface 204.

FIG. 2.

Figure 2:
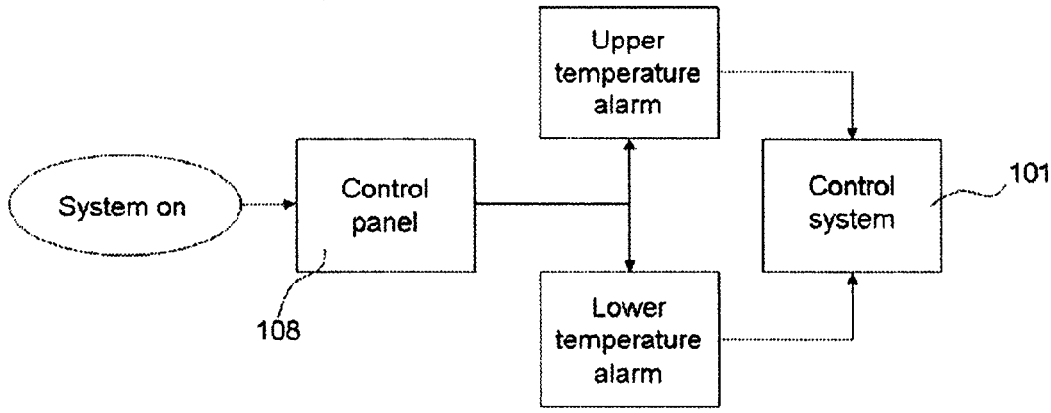
FIG. 2 is a schematic illustration describing the process of how to set up temperature alarms.

FIG. 2 illustrates how to set in-transit temperature alarms for the substance that present innovation is designed to maintain. The external device 100 may also contain a system on 108A mode. With the external device 100 in mode 108A the upper temperature alarm 108B and the lower temperature alarm 108C may be set by the control panel 108.

FIG. 3

Figure 3:
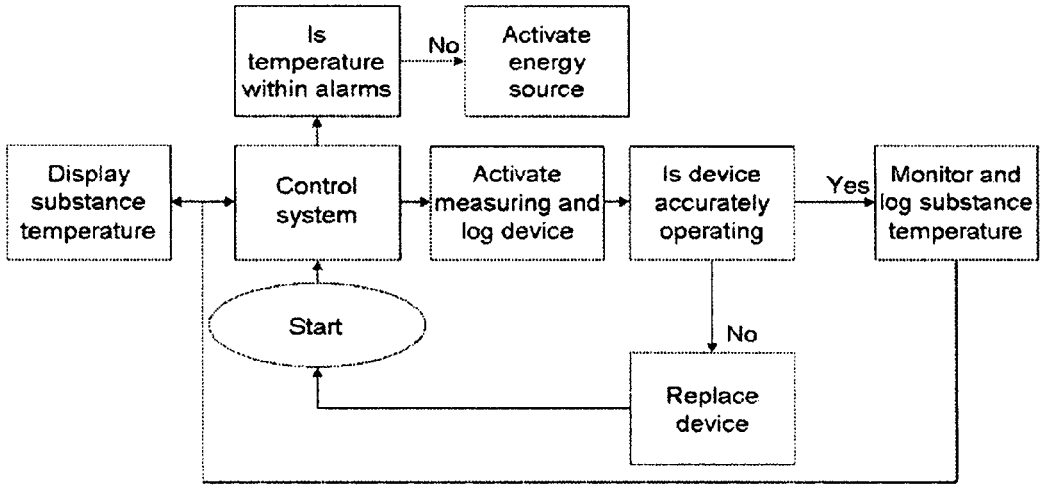
FIG. 3 is a flowchart describing the process of setting up the control system before its activation.

FIG. 3 illustrates a flow diagram of a typical operation for which the present innovation will operate in order to optimize the use of available energy. The actual operation of an active or passive energy source used to maintain product temperature within a packaging system is well known by anyone skilled in the art. The external device 100 may also contain a start 108E mode. When the control system 101 is started through operation of the control panel 108 the control system 101 remotely activates the measuring and log mode 101A in the internal device 200. The internal control system 201 verifies its operational functionality 101B automatically and starts to monitor and log substance temperature. Substance temperature 201A is remotely sent to the external device 100. The substance temperature 108D may be displayed through the control panel 108. If the internal device 200 fails to verify its operational functionality the control system 101 may report a relevant failure mode 101C.

FIG. 4

Figure 4:
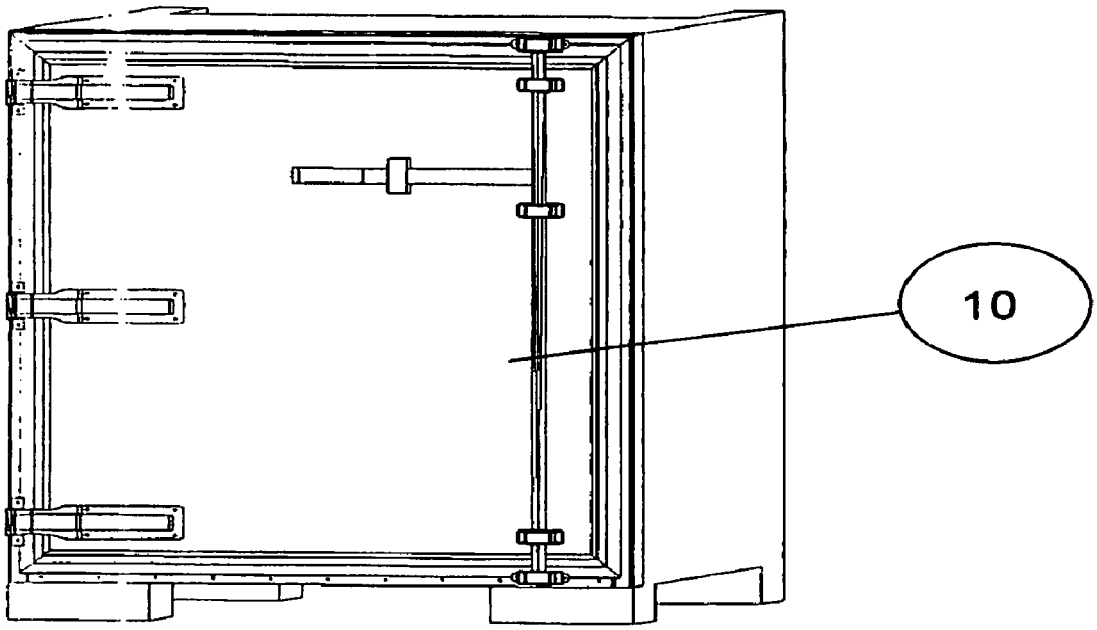
FIG. 4 is a flowchart describing the process of control system activation, temperature monitoring and logging, display of actual temperature and activation of available energy.

FIG. 4 illustrates a packaging system for which present innovation is designed to control substances that are temperature sensitive. The packaging system may also contain an external device 100. The external device 100 in combination with internal device 200 is designed to optimize the use of available energy.

FIG. 5

Figure 5:
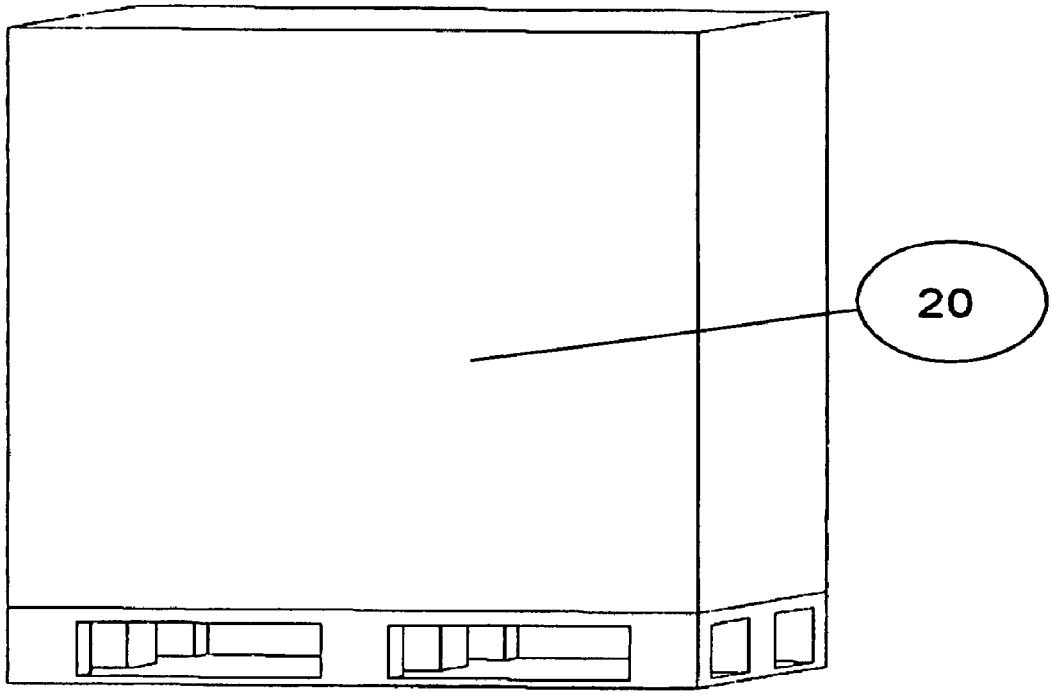
FIG. 5 is a perspective view of a packaging system having an electronic device according to the present invention.

FIG. 5 illustrates the substance that will be carried within the packaging system that present innovation may control. The substance is often placed on a pallet for ease in handling. The internal device 200 may be attached on the substance to monitor and log in transit substance temperature.

FIG. 6

Figure 6:
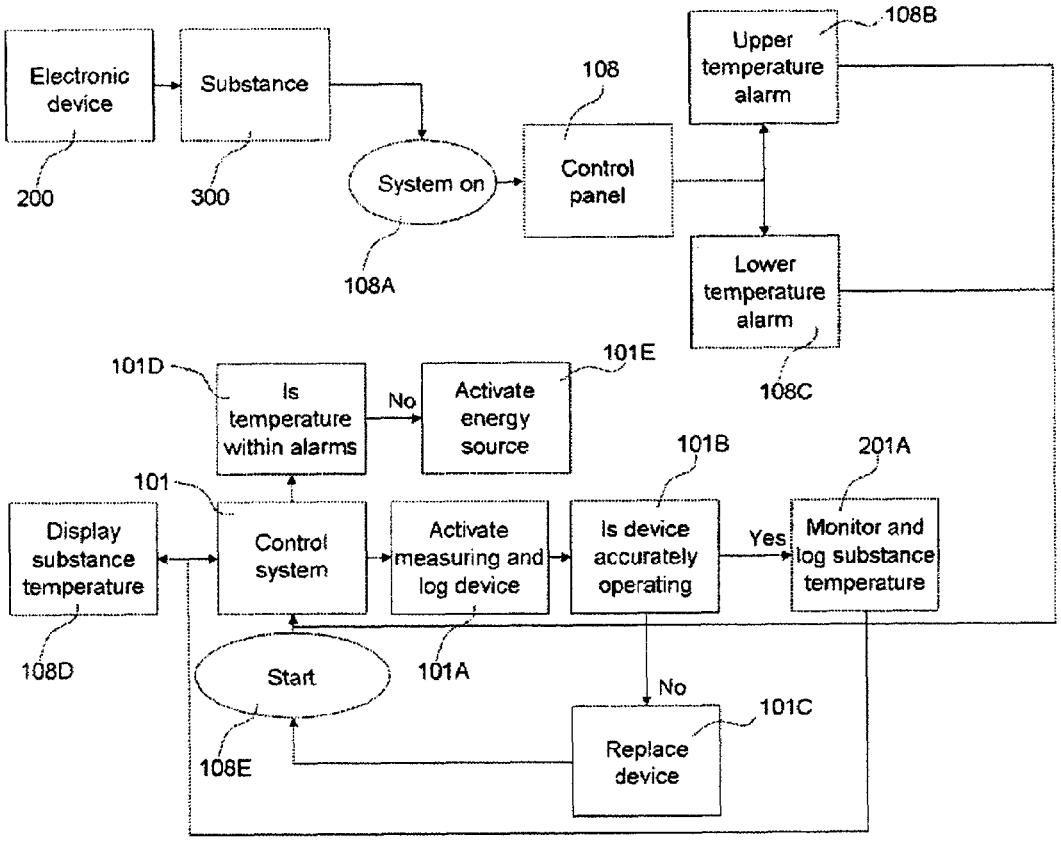
FIG. 6 is a perspective view of a substance loaded in the packaging system. Electronic devices monitor and log substance temperature so that present invention can control and maintain substance temperatures within given alarms.

FIG. 6 illustrates the flow of a typical operation for which within the present innovation will be used (note that the substance always must be preconditioned to its optimal temperature prior to transit);

1) Attach internal device 200 to the substance

2) Wrap the substance to prevent from toppling or tilting

3) Load the substance into the cargo area and strap it down

4) System in on mode 108A, set temperature alarms 108B and 108C

5) System in start mode 108E, the control system 101 starts to operate

6) Internal device 200 activated, verification of functionality 101B

7) Control system 101 starts its operation and substance will be maintained within set temperature alarms 8) Door to door distribution, substance temperature 108D may be displayed 9) System stop 108E de-activation of internal device 200.

10) Unload the substance and collect the internal device 200

11) Move the substance to cold storage

12) Download and review recorded data

The present innovation is particularly beneficial in connection to packaging systems designed to slow down heat exchange processes. The present innovation may be used in distribution systems requiring a packaging system that needs to carry temperature sensitive substances whereas the energy source is limited and needs to be carefully controlled to last throughout the distribution.

The invention is generally applicable to all areas storing, distributing, operating or handling temperature sensitive substances. Such areas could include cold storage rooms, refrigerators, transportation vessels, machinery of production, line of production, hospitals, laboratories where actual damage to substance may be caused if alarms are exceeded. Furthermore, the invention may optimize the use of energy in mentioned applicable areas as well.

The invention may be used to measure, transmit and control other operations as well such as, shock and vibration, humidity, explosives, accessibility to protected areas, fungus, mould, bacteria's etc.

It will be understood by those skilled in the art of various modifications and changes made to the present innovation without departure from the scope thereof, which is defined by the appendix claim.

The invention claimed is:

1. A method for storing or transmitting a temperature sensitive substance, the method comprising the steps of:

placing the substance within a thermally insulated container with ambient air;

measuring the temperature of the substance;

recording the measured temperature of the substance in relation to time;

retrieving the measured temperature of the substance to verify substance temperature over duration of time; and activating a temperature control system when the measured temperature of the substance approaches a predetermined upper or lower temperature such that the measured temperature of the substance is kept between the predetermined upper and lower temperatures while also being allowed to fluctuate between the predetermined upper and lower temperatures;

monitoring the temperature of ambient air within the thermally insulated container;

predicting the rate of temperature change of the substance in correlation with the temperature change of the ambient air within the thermally insulated container; and activating the temperature control system based in part on the predicted rate of temperature change of the substance.

2. A method for storing or transmitting a temperature sensitive substance, the method comprising the steps of:

placing the substance within a thermally insulated container with ambient air;

measuring the temperature of the substance;

recording the measured temperature of the substance in relation to time;

retrieving the measured temperature of the substance to verify substance temperature over duration of time; and activating a temperature control system when the measured temperature of the substance approaches a predetermined upper or lower temperature such that the measured temperature of the substance is kept between the predetermined upper and lower temperatures while also being allowed to fluctuate between the predetermined upper and lower temperatures;

monitoring the temperature outside the thermally insulated container;

predicting the rate of temperature change of the substance in correlation with the temperature change of the ambient air outside the thermally insulated container; and activating the temperature control system based in part on the predicted rate of temperature change of the substance.

* * * * *